US006013139A

United States Patent [19]

Tarkinson

[11] Patent Number: 6,013,139

[45] Date of Patent: Jan. 11, 2000

[54] METHOD OF CLEANING CARPETS

[76] Inventor: Edward G. Tarkinson, 4155 Fox Trace East, Boynton Beach, Fla. 33436

[21] Appl. No.: 09/294,106

[22] Filed: Apr. 19, 1999

[51] Int. Cl.[7] ..... B08B 3/14; B08B 7/00; D06F 11/26; C11D 17/04

[52] U.S. Cl. ..... 134/42; 134/6; 8/137; 510/278; 510/280

[58] Field of Search ..... 134/6, 42; 8/137; 510/278, 280

[56] References Cited

U.S. PATENT DOCUMENTS

| | | | |
|---|---|---|---|
| 2,625,515 | 1/1953 | Witwer | 252/137 |
| 4,090,974 | 5/1978 | Morganson | 252/135 |
| 4,186,031 | 1/1980 | Armstron et al. | 134/1 |
| 4,279,796 | 7/1981 | Tarkinson | 260/29.6 |
| 4,311,608 | 1/1982 | Maurice | 252/143 |
| 4,504,407 | 3/1985 | Klutz, Jr. et al. | 252/162 |
| 4,655,952 | 4/1987 | Mesmer et al. | 252/88 |
| 4,781,855 | 11/1988 | Shaw et al. | 252/135 |
| 4,908,149 | 3/1990 | Moore et al. | 252/139 |
| 5,259,848 | 11/1993 | Terry et al. | 8/111 |
| 5,728,669 | 3/1998 | Tyerech | 510/280 |

*Primary Examiner*—Necholus Ogden
*Attorney, Agent, or Firm*—Oltman, Flynn & Kubler

[57] ABSTRACT

A chemical composition useful for carpet cleaning having a selected combination of alcohols, Borax, sodium tripolyphosphate, hydrogen peroxide, bicarbonates and other alkaline components. Additionally, a method of cleaning carpets with the proposed cleaning composition using a mechanically driven pad to buff a carpet wetted with the composition. The chemical composition is preferably sprayed onto the carpet, which is then buffed to ensure complete penetration of the cleaning compound and removal of soil or staining material.

1 Claim, No Drawings

METHOD OF CLEANING CARPETS

This invention relates generally to chemical compositions and in particular to a composition suitable for cleaning carpets and to a method of cleaning carpets using such a chemical composition.

BACKGROUND OF THE INVENTION

Carpet cleaning solutions derive their popularity from the fact that most carpets are easily soiled due to their high exposure to traffic and spills. Cleaning solutions provide a way to maintain pleasant aesthetic qualities for these carpets and avoid the expensive but often used remedy of replacing soiled carpets.

A variety of solutions are known in the art for cleaning carpets. U.S. Pat. No. 2,625,515 discloses the use of alcohols and boric acid in a cleaning solution. U.S. Pat. Nos. 4,090,974 and 4,781,855 teach the inclusion of sodium tripolyphosphate in cleaning solutions, while U.S. Pat. Nos. 5,259,848 and 5,728,669 teach the use of hydrogen peroxide in cleaning solutions.

While not without merit, the none of these inventions include the advantages of the present invention. These advantages include an increased ability to remove scuffmarks and stubborn stains, including stains from wine and coffee, over that previously known. The invention also freshens and deodorizes the carpets to which it is applied. It inhibits the growth of mildew and can help to remove other allergens such as dust, mites, and animal dander.

Use of the present solution improves the luster of a worn carpet by mercerizing, slack mercerizing and decating the carpet fabric. These processes typically involve the treatment of fabric with caustic soda or steam and hot water solutions. They are often used to improve the luster and strength of fabrics. The present solution includes certain combinations of caustic chemicals that have effects equivalent or similar to those of mercerizing and decating when applied to carpet fabric. It is believed that the inclusion of other chemicals at particular amounts not typically used while mercerizing or decating increases the effectiveness of the solution as a whole in this regard.

The staining of carpets is generally understood to result from either the formation of ionic bonds between the fibers of a carpet and anionic staining material (in the case of acid dyes) or simple absorption of staining components by the carpet fibers. Although carpet fibers are typically treated to prevent staining, these procedures are not entirely effective and there is a need for a solution to help remove these stains from carpet fibers.

The present invention includes a distinct combination of essential ingredients. The prior art does not teach or suggest the chemical composition disclosed. The particular combination results in a cleaning solution with properties beyond those that might otherwise have been expected from such a solution. The whole here has properties greater than the sum of its parts.

SUMMARY OF THE PRESENT INVENTION

It is a primary object of the present invention to provide a solution suitable for removing soil and stains from carpets.

It is another object of the present invention to provide a solution effective in freshening, cleaning, and deodorizing carpet and preventing the growth of mildew.

Yet another object of this invention is to provide a solution which will help to suppress allergens such as dust, mites, and animal dander.

A further object of this invention is to provide a solution that will brighten and strengthen carpet by effectively mercerizing and decating the carpet fibers.

Another object of this invention is to provide a method of cleaning carpets with a solution having the foregoing properties.

DETAILED DESCRIPTION OF THE INVENTION

The invention is a chemical composition suitable for cleaning carpets. The composition includes bicarbonate of soda and other more alkaline agents, boric acid, Borax, peroxide, alcohols, and water.

The bicarbonate acts to raise the pH of the solution, allowing the peroxide to work in destroying the staining molecules. The preferred bicarbonate is sodium bicarbonate at a concentration of 0.1 to 0.8% by weight. This is combined with hydrogen peroxide at a concentration of 1.5 to 3.0% by weight. Hydrogen peroxide is known to increase the cleaning capability of carpet cleaning solutions. Addition of alcohols to the cleaning solution promotes complete saturation of the carpet fibers by enhancing the cleaning solution's penetration of the carpet fibers and thereby promotes thorough cleaning of the carpet. Preferred alcohols are ethyl and isopropyl in concentrations of 0.3 to 1.0 and 0.5 to 2.0% by weight, respectively.

A highly alkaline component with some surfactant activity and minimal foaming is also included in the cleaning solution. Preferably this is sodium tripolyphosphate at a weight percentage of 1.0 to 2.9. Borax is also included in the cleaning solution. This may be in the form of sodium borate or sodium tetraborate at a concentration of 1.6 to 3.5% by weight. The solution also contains boric acid at a weight percentage of 0.1 to 0.6.

The cleaning properties of the solution created by these chemicals combined at these particular ratios are significantly increased over the cleaning properties previously found in similar chemical cleaners.

The preferred method of use for the solution follows a thorough vacuuming of the carpet. The solution is then sprayed onto the carpet to wet the carpet's fibers. A motor-driven, resilient, absorbent pad is used to buff the carpet. This buffing strengthens the penetration of the solution into the carpet, and enables better cleaning of the carpet. The buffing also acts to remove the dirt and soil from the carpet, allowing the buffing pad to absorb such undesirable contaminants. After buffing, the carpet is allowed to dry for a number of hours and is then vacuum cleaned again.

While the invention has been described and disclosed in various terms and certain embodiments, the scope of the invention is not intended to be, nor should it be deemed to be, limited thereby and such other modifications or embodiments as may be suggested by the teachings herein are particularly reserved especially as they fall within the breadth and scope of the claims here appended.

What is claim is:

1. A method of cleaning carpets comprising the steps of: applying to the carpet a chemical solution comprising:

by weight, 1.0 to 2.9% sodium tripoly phosphate;

by weight, 0.1 to 0.6% boric acid;

by weight, 0.1 to 0.8% sodium bicarbonate;

by weight, 0.3 to 1:0% ethyl alcohol;

by weight, 0.5 to 2.0% isopropyl alcohol;

by weight, 1.6 to 3.5% of a compound from the group consisting of sodium borate and sodium tetraborate;

by weight, 1.5 to 3.0% hydrogen peroxide;

by weight, 85 to 90% water; and mechanically buffing the carpet to cause thorough penetration of the carpet with the solution.

* * * * *